United States Patent [19]

Mulcahy et al.

[11] Patent Number: 4,674,412

[45] Date of Patent: Jun. 23, 1987

[54] ELASTOMERIC BEARING PAD WITH UNLIKE THREADED FASTENERS

[75] Inventors: Harry W. Mulcahy, Griffith, Ind.; Stanley Karbowniczek, Chicago, Ill.

[73] Assignee: AMSTED Industries Incorporated, Chicago, Ill.

[21] Appl. No.: 810,698

[22] Filed: Dec. 19, 1985

[51] Int. Cl.[4] ..... B61F 5/30

[52] U.S. Cl. ..... 105/224.1; 105/218.1

[58] Field of Search ..... 105/224.1, 218 R, 220, 105/221 K, 225, 222, 218.1, 221.2

[56] References Cited

U.S. PATENT DOCUMENTS

| | | | |
|---|---|---|---|
| 3,276,395 | 10/1966 | Heintzel | 105/224.1 |
| 3,638,582 | 2/1972 | Beebe | 105/224.1 X |
| 3,839,969 | 10/1974 | Thum | 105/224.1 |
| 4,552,074 | 11/1985 | Mulcahy et al. | 105/224.1 |

FOREIGN PATENT DOCUMENTS

| | | | |
|---|---|---|---|
| 460000 | 1/1937 | United Kingdom | 105/224.1 |

*Primary Examiner*—Robert B. Reeves
*Assistant Examiner*—Scott H. Werny
*Attorney, Agent, or Firm*—Charles E. Bouton; Edward J. Brosius

[57] ABSTRACT

A railway vehicle truck of the four wheel type is provided having elastomeric devices operative in shear and disposed between the side frame and wheelsets in such a manner as to reduce hunting and to permit turning of wheelsets during curving. Each elastomeric device is threadably fastened to the side frame with a central boss having an internally threaded bore engaged by a bolt and to the bearing adapter with an externally threaded stud in a manner such that the relative movement of mating surfaces is precluded.

6 Claims, 8 Drawing Figures

FIG. 5
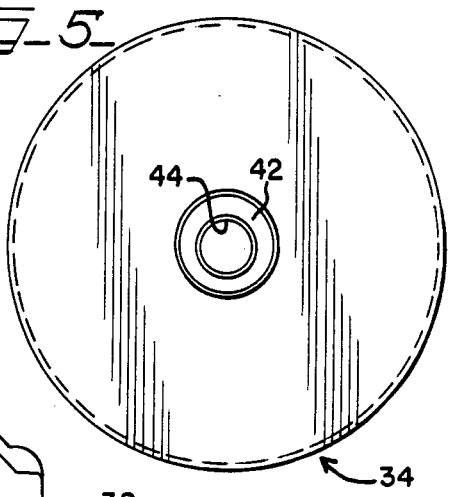
FIG. 4
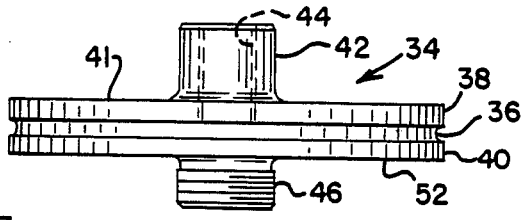
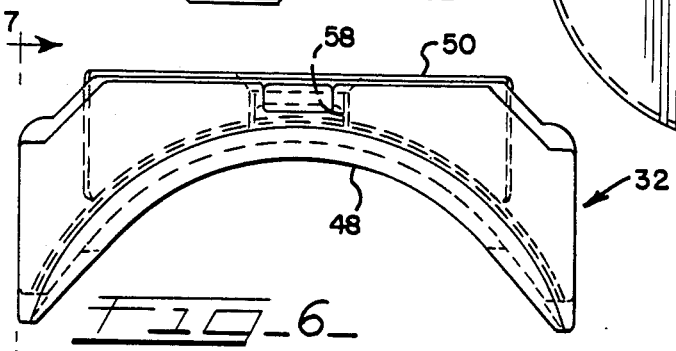
FIG. 6
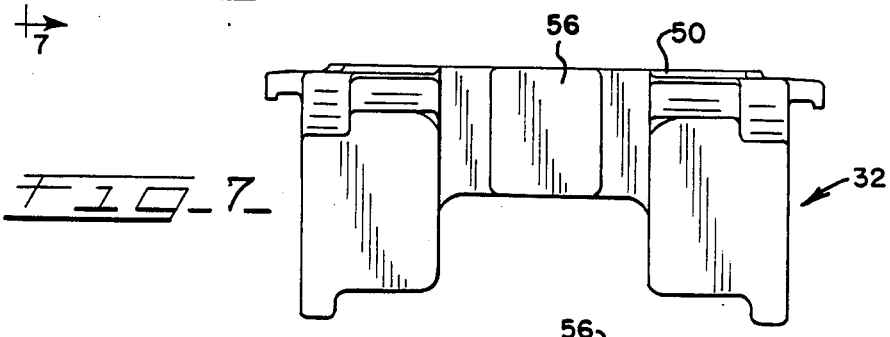
FIG. 7
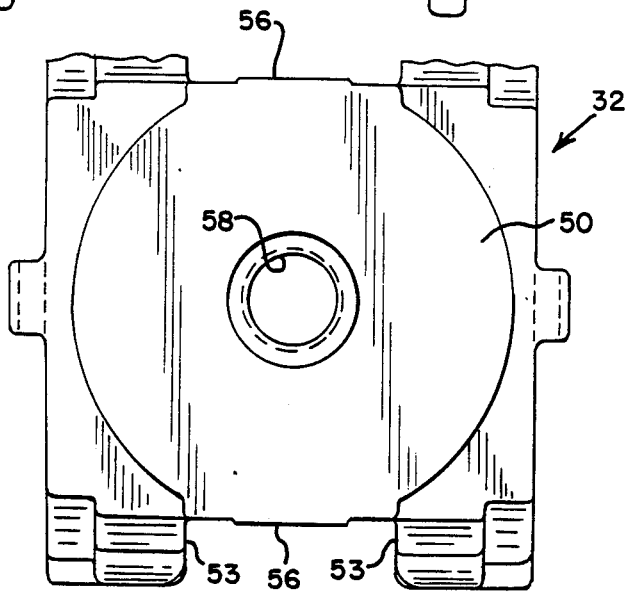
FIG. 8

ELASTOMERIC BEARING PAD WITH UNLIKE THREADED FASTENERS

BACKGROUND OF THE INVENTION

The present invention relates to trucks for railway vehicles and more particularly to an arrangement for keeping truck components aligned in a generally rectangular configuration during operation.

Railway vehicle trucks of the present invention comprise generally a pair of laterally extending and longitudinally spaced wheelsets, each set including an axle on each end of which there is mounted a wheel and a bearing assembly. The wheelsets are connected by side frames supported on the axles by bearing adaptors mounted on the axles. The side frames and the wheelsets are mounted on the underside of the railway vehicle car bodies in the conventional manner by way of bolsters resiliently supported adjacent each end on the laterally spaced side frames. Trucks of this general construction are conventionally known as four wheel trucks.

Such trucks have a tendency to hunt and yaw during normal operation of the railway vehicle along the track. To minimize such hunting and yawing, elastomeric devices have been interposed between the wheelsets and the side frames to restrain hunting and yawing by maintaining the wheelsets and the side frames in a generally ninety degree relationship to each other on nominally straight track while permitting limited restrained relative turning of the wheelsets and side frames when the trucks travel along curved tracks. Such elastomeric devices typically comprise an elastomeric pad bonded and sandwiched between a pair of metal plates. Typical structures of the prior art are shown in U.S. Pat. Nos. 3,638,582 and 3,381,629. Similar structures are also described in U.S. Pat. Nos. 4,416,203, 4,363,278 and 3,699,897.

Each of the prior art structures and arrangements were found to be unsuitable for general application to railway vehicles for the basic reason that the elastomeric pad failed to perform its intended functions.

SUMMARY OF THE INVENTION

By the present invention, it is proposed to overcome the difficulties encountered heretofore. To this end, it has been discovered that a firm and non-separating relationship must be established at the mating attachment surfaces of the elastomeric device metal plates and the bearing adapter and side frames. In the absence of such a firm and non-separating relationship, it has been discovered that under certain magnitudes of shear displacement, separation at the mating attachment surfaces of the elastomeric device and truck members, materially alters the intended function of the elastomeric pad. The effective stiffness of the elastomeric pad is materially reduced in the plane resisting relative turning of the wheelsets and side frames so that excessive hunting occurs. Also, separation of the mating attachment surfaces creates a condition during train operation resulting in a peening effect on the elastomeric pad and its lateral and longitudinal mating surfaces so as to destroy its resilient characteristics whereby it fails and thereby reduces the useful operating life of the elastomeric device.

By the present invention, these difficulties are overcome by providing an attachment between the mating surfaces which eliminates any separation therebetween during train operation.

Generally, this is accomplished by providing flat mating attachment surfaces on the side frame and bearing adapter and providing the metal plates of the elastomeric device with complimentary flat mating surfaces. The elastomeric device is provided on one of its mating faces or surfaces with an upwardly projecting boss which is received within a bore provided in the pedestal roof of the side frame. The boss includes an internal thread into which there is threaded a bolt having a head tightly seated on a washer supported on the pedestal roof above the opening receiving the boss. The threaded bolt is securely tightened into the internally threaded bore of the boss so that the mating surface of the resilient device is securely held in firm face-to-face engagement with the flat mating surface on the pedestal roof. The opposite side of the resilient device includes a downwardly projecting threaded stud. The threaded stud is screwed into an internally threaded opening formed in the bearing adapter. The stud and bolt are each provided with threads of the same hand to prevent loosening of the connections. With the resilient device thus threadably fastened on both sides, the mating surfaces of the device with the side frame and bearing adapter are maintained against separation so that no slippage between the surfaces occurs.

Further features of the present invention will be apparent from the following.

BRIEF DESCRIPTION OF THE DRAWINGS

FIG. 4 is a side elevational view of the elastomeric device.

FIG. 5 is a top plan view of the device shown in FIG. 4.

FIG. 6 is a front elevational view of the bearing adapter.

FIG. 7 is an end view of the bearing adapter taken generally along the Lines 7—7 of FIG. 6.

FIG. 8 is a fragmentary top plan view of the bearing adapter.

DESCRIPTION OF THE PREFERRED EMBODIMENT

Figure 1:
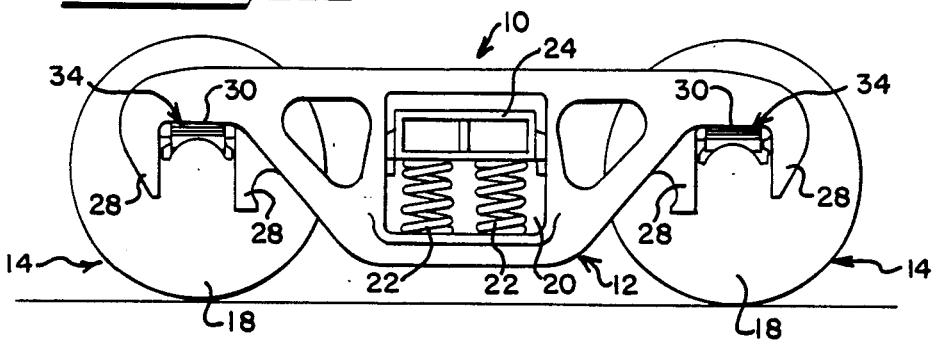
FIG. 1 is a side elevational view of a railway vehicle incorporating the structure of the present invention.

Referring now to the drawings, in particular FIG. 1, there is shown a railway vehicle truck 10 embodying the structure of the present invention. The truck 10 of which only one side is shown comprises generally a pair of side frames 12 mounted on lengthwise spaced wheelsets 14. The wheelsets 14 each include an axle 16 to the outer ends of which there are mounted wheels 18 and roller bearings 26.

The side frames 12 each include a bolster opening 20 in which bolster 24 is resiliently supported by springs 22. Bolster 24 is suitably attached to the underside of the railway vehicle car body (not shown) by means of a center plate (not shown).

Figure 3:
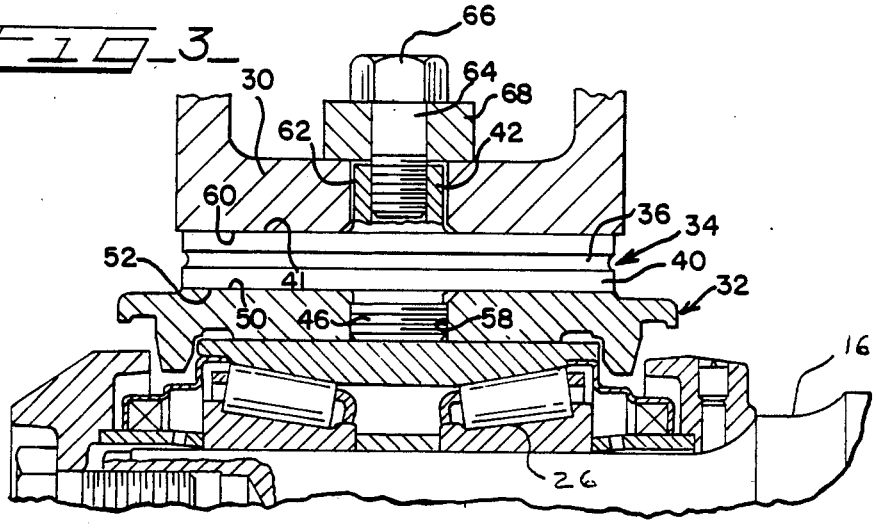
FIG. 3 is an enlarged cross sectional view taken generally along the lines 3—3 of FIG. 2.

Mounted on the axle 16 are bearings 26 as shown in FIG. 3. The bearings 26 are disposed between pedestal jaws 28—28 projecting downwardly from a pedestal roof 30 of side frame 12. Mounted on and embracing the bearing 26 is bearing adapter 32.

The resilient or elastomeric device 34 incorporating the structure of the present invention is disposed between the pedestal roof 30 and the bearing adapter 32. The elastomeric device 34 serves to assist in restraining the wheelsets 14 and side frames 12 from turning out of square or right angular relationship during train operation and thereby substantially reduces the undesirable hunting characteristics of the trucks. At the same time the elastomeric device 34 permits limited relative restrained turning of the wheelsets 14 and side frames 12 when the trucks travel on curved sections of track.

The elastomeric device or assembly 34 as shown in particular in FIGS. 4 and 5 includes a circular resilient or elastomeric pad 36 which is sandwiched between the opposing faces of an upper circular metal plate 38 and a lower circular metal plate 40. If desired, pad 36 can be bonded to metal plates 38 and 40 by gluing or other methods. The pad 36 is preferably made from natural rubber and provides a resisting force in shear between its opposing faces when opposing forces are applied thereon.

Projecting upwardly from the exposed face 41 of the upper plate 38 is a boss 42 having an internally threaded bore 44. The lower plate 40 is formed with an externally threaded stud 46 coaxially disposed relative to the boss 42. The upper and lower plates 38 and 40, respectively, are preferably made from steel and elastomeric pad 36 is sandwiched therebetween.

In accordance with the present invention, the bearing adapter 32, as shown in FIGS. 2, 3, 6, 7 and 8, is of block-like form having a lower concave surface 48 adapted to seat on bearing 26. A flat mating surface or face 50 for mating with a mating face 52 of lower plate 40 of elastomeric device 34 is formed on the opposite side. The mating face 50 is preferably machine finished to assure substantial face-to-face contact with the elastomeric device face 52.

Projecting from the sides of the bearing adapter 32 are thrust lugs 53 which coact with thrust lugs 54 on the pedestal legs 28 to limit lateral movement of bearing adapter 32. Thrust shoulders 56 also interact with thrust lugs 54 to limit longitudinal movement of bearing adapter 32.

Mating face 50 on bearing adapter 32 is preferably circular such as shown in FIG. 8. Coaxially extending through the face 50 and into the adapter is an internally threaded hole 58.

Figure 2:
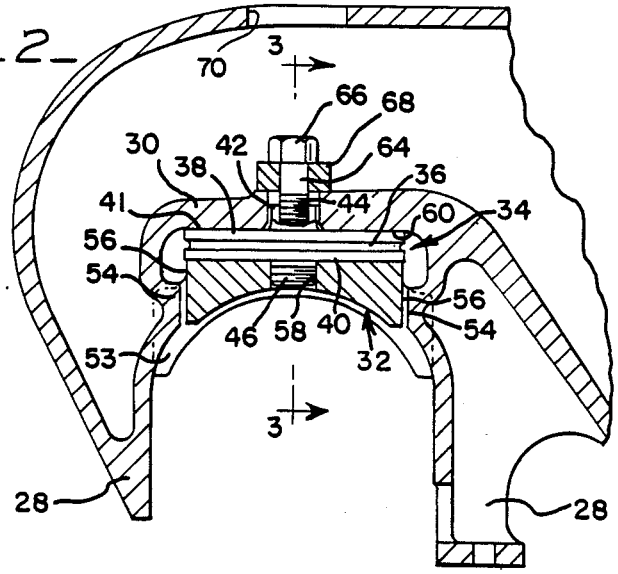
FIG. 2 is an enlarged fragmentary view partially in cross section of one end of the truck at the side frame pedestal yoke and illustrating the elastomeric device of the present invention and its connection to the side frame and bearing adapter.

The underside of the pedestal roof 30, as shown in FIGS. 2 and 3, is also preferably machine finished to provide a flat surface or face 60 which mates with face 41 on elastomeric device 34. Mating face 60 may be contoured similar to the bearing adapter face 50. An opening 62 extends through the pedestal roof 30 for accommodating the boss 42 of the elastomeric device therein. There is a clearance between boss 42 and opening 62 so that the wheelsets can be precisely squared prior to tightening of bolt 64.

Elastomeric device 34 is secured between the side frame 12 and wheelset 14 by screwing externally threaded stud 46 into internally threaded opening 58 of bearing adapter 32. Elastomeric device 34 is screwed into the adapter 32 sufficiently tight to maintain the mating faces 50 and 52 in firm and non-slipping engagement.

Boss 42 is inserted into the pedestal roof opening 62 and a threaded bolt 64 is screwed into the internally threaded bore 44. Disposed between pedestal wall 30 and head 66 of bolt 64 is a relatively thick washer 68. Bolt 64 is tightened so as to apply a clamping force on washer 68 sufficient to prevent relative motion of the elastomeric device mating surface 41 with the pedestal mating surface 60. The bolt 64 and washer 68 are emplaced through an aperture 70 in the sideframe above the pedestal roof (as seen in FIG. 2).

It is to be noted that externally threaded stud 46 and threaded bolt 64 are both provided with threads of the same hand, i.e., both are provided with either right hand threads or left hand threads. This is important because upon relative turning of the wheelset and side frame in opposite directions, any tendency of either of the threaded engagements of the stud 46 or bolt 64 to loosen is resisted by the requirement that the other one of the threaded engagements be tightened.

In operation, elastomeric pad 36 of elastomeric device 34 during travel of the truck along straight track serves to restrain hunting by assisting in maintaining the wheelsets 14 at substantially right angles with side frames 12 thereby inhibiting hunting. At the same time, resilient or elastomeric pad 36 permits the relative limited turning of axles 16 and side frames 12 so as to facilitate curved track negotiation. When the truck returns to straight trackage, pads 36 are operative to return axle 16 and side frames 12 to their right-angular relationship.

During travel of the railway vehicle, horizontal forces are generated on the truck and car body so that the elastomeric pad 36 deforms in shear and thereby serves to isolate the wheelsets from the vehicle superstructure which results in improved yaw and lateral stability of the vehicle. At the same time, elastomeric pads 36 permit limited turning of the wheelsets. Of significance with the structure of the present invention, is the fact that elastomeric devices 34 are secured to side frame 12 and bearing adapter 32 such that no separation occurs between the mating surfaces 50–52 and 41–60 along the entire areas thereof. In the prior art devices wherein such separation occurred, the elastomeric devices were incapable of providing a uniform and consistent shear stiffness to inhibit hunting and frequently, due to the peening effects resulting from such separation, the devices failed. With the structure of the present invention, such problems are obviated.

What is claimed is:

1. In a truck for a railway vehicle including longitudinally spaced wheelsets each including an axle, wheels, and bearings mounted thereon, a pair of laterally spaced side frame each having pedestal jaws depending from a pedestal roof at each end of said sideframe for accommodating said bearing on said axle, a bearing adapter disposed between said pedestal jaws and mounted on said bearings, the improvement comprising:

an elastomeric device disposed between said bearing adapter and said pedestal roof, said elastomeric device including an elastomeric pad interposed between the opposing surfaces of an upper plate and a lower plate;

planar surfaces formed on the exposed surfaces of said upper and lower plates, said upper plate planar surface having a central boss projecting upwardly and an internally threaded bore within said boss;

a first planar surface on said pedestal roof engageable in face-to-face contact with said planar surface of said upper plate, said first planar surface being provided with an opening to receive said boss;

a second planar surface on said bearing adapter matingly engagable with said planar surface on said lower plate;

an externally threaded stud projecting from said lower plate for threadably fastening said elastomeric device into a matingly threaded hole in said bearing adapter to hold said planar surface on said lower plate in firm fact-to-face engagement with said second planar surface;

and an externally threaded bolt means extending through said pedestal roof into contact with said central boss of said upper plate for holding said planar surface on said upper plate in firm fact-to-face engagement with said first planar surface.

2. The railway truck of claim 1 wherein said elastomeric pad interposed between said upper and lower plates is operative to provide a shear stiffness sufficient to assist in retaining said side frame and said wheelsets in a substantially right angular relationship during travel of said truck over straight track and permitting limited relative turning therebetween when said truck traverses curved tracks.

3. The improvement as defined in claim 1 wherein said first threaded fastening means and said second threaded fastening means are provided with threads of the same hand.

4. The improvement as defined in claim 1 wherein said bolt is provided with a washer disposed between a head of said bolt and said pedestal to assure that a firm engagement between the planar surfaces may be achieved when said bolt is threaded into said internally threaded bore.

5. The improvement as defined in claim 4 wherein said elastomeric device is generally cylindrical and said engaging planar surfaces on said elastomeric device and said pedestal roof and said bearing adapter are of approximately circular contour.

6. The truck defined in claim 1 including an aperture in said sideframe above the pedestal roof providing access to said opening in said pedestal roof.

* * * * *